US010058177B2

(12) United States Patent
Park et al.

(10) Patent No.: US 10,058,177 B2
(45) Date of Patent: Aug. 28, 2018

(54) HOME APPLIANCE

(71) Applicant: LG Electronics Inc., Seoul (KR)

(72) Inventors: Hyoungjun Park, Changwon-si (KR); Jongmi Choi, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 761 days.

(21) Appl. No.: 14/146,473

(22) Filed: Jan. 2, 2014

(65) Prior Publication Data

US 2014/0184046 A1 Jul. 3, 2014

(30) Foreign Application Priority Data

Jan. 2, 2013 (KR) ..... 10-2013-0000087

(51) Int. Cl.
*F25D 29/00* (2006.01)
*A47B 96/20* (2006.01)

(52) U.S. Cl.
CPC ..... *A47B 96/20* (2013.01); *F25D 29/00* (2013.01); *F25D 2400/361* (2013.01); *F25D 2700/02* (2013.01)

(58) Field of Classification Search
CPC ..... F25D 2500/06; F25D 2700/06; F25D 2700/02
See application file for complete search history.

(56) References Cited

U.S. PATENT DOCUMENTS 9,503,635 B2 * 11/2016 Ryu ..... H04N 5/2252
2006/0111815 A1 * 5/2006 Schanin ..... G07C 3/08 700/276
2008/0295033 A1 * 11/2008 Lee ..... F25D 23/126 715/840
2009/0141117 A1 * 6/2009 Elberbaum ..... G07C 9/00571 348/14.04
2010/0107679 A1 * 5/2010 Park ..... F25D 23/028 62/441
2012/0260683 A1 * 10/2012 Cheon ..... F25D 29/00 62/125
2017/0010040 A1 * 1/2017 Kim ..... F25D 29/005

FOREIGN PATENT DOCUMENTS

| | | | |
|---|---|---|---|
| CN | 1065134 | A | 10/1992 |
| CN | 1975296 | A | 6/2007 |
| CN | 102401544 | A | 4/2012 |
| JP | 09-053879 | A | 2/1997 |
| JP | 11-237167 | A | 8/1999 |
| KR | 1020120118641 | A | 4/2011 |

* cited by examiner

*Primary Examiner* — Ljiljana Ciric
*Assistant Examiner* — Alexis Cox
(74) *Attorney, Agent, or Firm* — Dentons US LLP

(57) ABSTRACT

A home appliance includes a main body having a storage compartment, a door that opens or closes the storage compartment, a detection unit to detect an opening or closing of the door, a display unit disposed on the main body or the door to display information, and a control unit to control the display unit on the basis of the detection by the detection unit. The control unit changes a display on the display unit from a main screen to a function management screen in response to a command inputted on the main screen when the main screen is displayed on the display unit, and the control unit changes a display on the display unit from the main screen to the function management screen in response to the opening or closing of the door detected by the detection unit when the main screen is displayed on the display unit.

10 Claims, 6 Drawing Sheets

HOME APPLIANCE

CROSS-REFERENCE TO RELATED APPLICATIONS

The present application claims priority under 35 U.S.C. 119 and 35 U.S.C. 365 to Korean Patent Application No. 10-2013-0000087 (filed on Jan. 2, 2013), which is hereby incorporated by reference in its entirety.

BACKGROUND

In general, home appliances are, for example, equipment that receives electricity to operate in the home. Home appliances may include refrigerators, washing machines, cleaners, cookers, and the like.

A refrigerator as an example of a home appliance may include a display unit for displaying information as disclosed in Korean Patent Publication No. 2012-0118641.

A user may select menus such as environment setting, food management, recipe, refrigerator management, and the like to confirm a detailed screen of the selected corresponding menu through the display unit.

However, in the refrigerator according to the related art, if it is intended that the user manages a specific menu, the user may select a corresponding menu on a main screen and then select a specific button on a detailed menu.

Thus, the user has to seek a desired menu from various menus and then select a corresponding button after confirming a detailed menu, thereby causing user's inconvenience.

SUMMARY

Embodiments relate to a home appliance.

In one embodiment, a home appliance includes: a main body having a storage compartment; a door opening/closing the storage compartment; a detection unit detecting an opened or closed state of the door; a display unit disposed on the main body or the door to display information; and a control unit controlling the display unit on the basis of the detection by the detection unit, wherein a screen that is capable of being displayed on the display unit includes a main screen and a function management screen that is displayed when a selection is capable of being made with respect to the main screen, and when the opened or closed state of the door is detected by the detection unit, the control unit displays the function management screen on the display unit.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Figure 1:
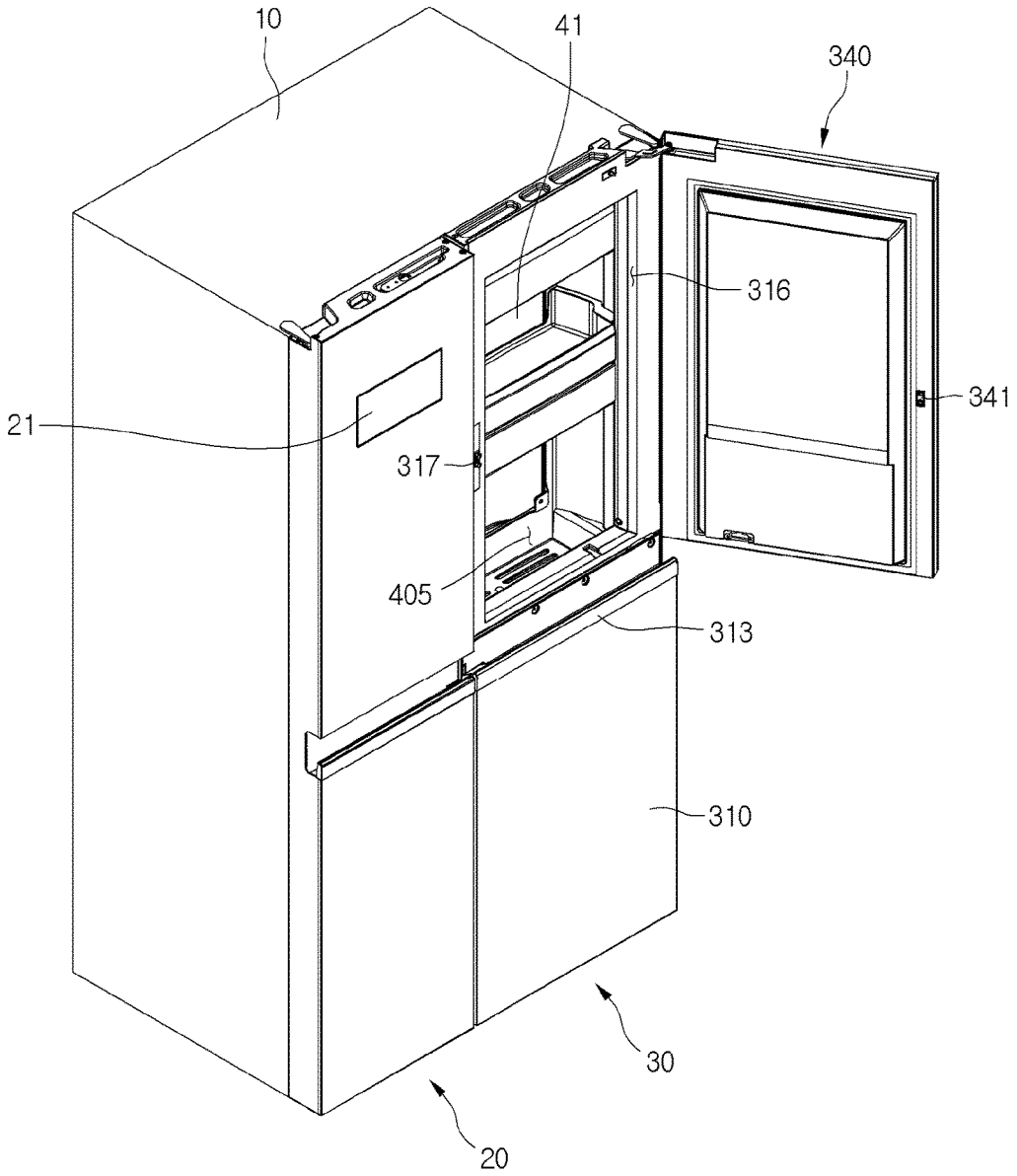
FIG. 1 is a perspective view of a refrigerator that is an example of a home appliance according to an embodiment.
Figure 2:
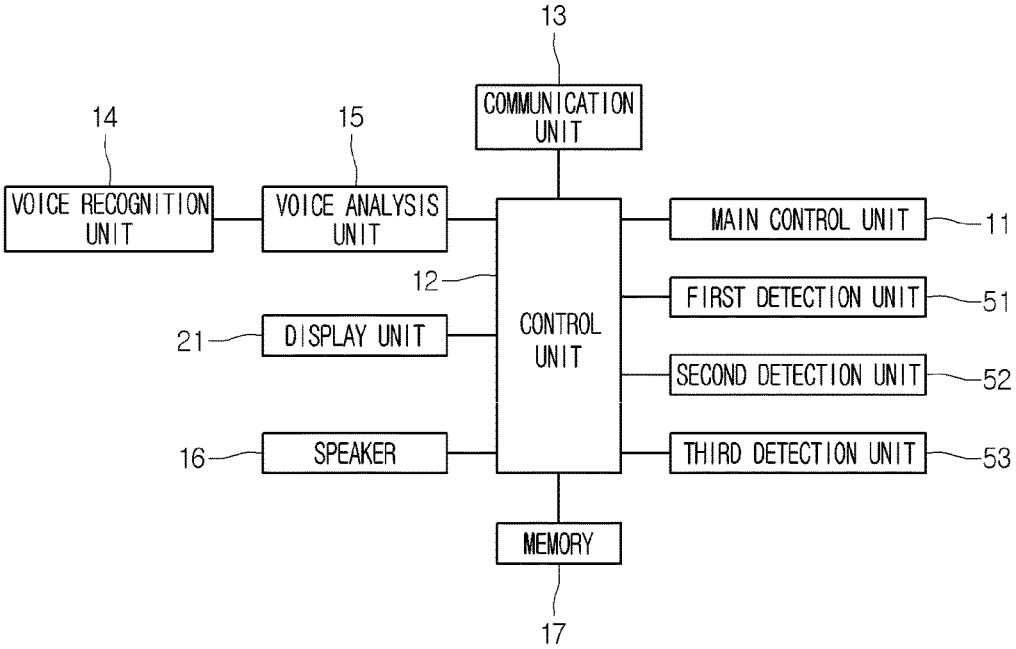
FIG. 2 is a control block diagram of the refrigerator of FIG. 1.

FIG. 1 is a perspective view of a refrigerator that is an example of a home appliance according to an embodiment, and FIG. 2 is a control block diagram of the refrigerator.

Referring to FIGS. 1 and 2, a refrigerator according to an embodiment may include a cabinet 10 having a storage compartment and doors 20 and 30 for opening/closing the storage compartment.

The storage compartment may include a freezing compartment (not shown) and a refrigerating compartment (not shown). The freezing compartment may include a supercooling compartment. The supercooling compartment may be understood as a storage compartment for storing foods at a temperature lower than that in the freezing compartment. The supercooling compartment may be opened or closed by a supercooling compartment door.

Although a side by side type refrigerator in which the freezing compartment is disposed at a left side, and the refrigerating compartment is disposed at a right side is described as an example, the embodiment may be applicable to a top mount type refrigerator in which the freezing compartment is disposed at an upper side, and the refrigerating compartment is disposed at a lower side, a bottom freezer type refrigerator in which the freezing compartment is disposed at a lower side, and the refrigerating compartment is disposed at an upper side, or a refrigerator in which only the freezing or refrigerating compartment is provided.

The doors 20 and 30 may include a freezing compartment door 20 for opening/closing the freezing compartment and a refrigerating compartment door 30 for opening/closing the refrigerating compartment.

An accommodation device 41 for accommodating foods is disposed on a back surface of the refrigerating compartment door 30. The accommodation device 41 may have a home bar space 405. The accommodation device 41 is separably coupled to the back surface of the refrigerating compartment door 30.

The refrigerating compartment door 30 may include a main door 310 for opening/closing the refrigerating compartment and a sub door 340 rotatably connected to the main door 310.

The main door 310 has an opening 316, and the opening 316 may communicate with the home bar space 405. Also, the home bar space 405 may communicate with the refrigerating compartment. In the case of the bottom freezer type refrigerator, at least one of a plurality of refrigerating compartment doors may include a main door and a sub door.

The sub door 340 may be rotated to open the opening 316 in a state where the main door 310 closes the refrigerating compartment.

Here, the sub door 340 may have a horizontal width equal to that of the main door 310. Thus, a sense of unity of the sub door 340 and the main door 310 may be created to improve a sense of beauty of the refrigerating compartment door.

A latch hook 341 to be coupled to the main door 310 may be disposed on a back surface of the sub door 340, and a latch slot 317 to which the latch hook 341 couples may be defined in the main door 310.

Since structures of the latch hook 341 and the latch slot 317 are well-known in the art, their detailed descriptions will be omitted.

The refrigerator may further include a communication unit 13 directly or indirectly communicating with an external component, a display unit 21 for displaying at least one of information of the refrigerator or information received from the outside, a control unit 12 for controlling the display unit 21, and a main control unit 11 connected to the control unit 12 to control an operation of the refrigerator.

The external component may include, for example, a web server, a mobile phone, the other electric appliance, a server of a power company, a server of a product distributor, a server of a food purchaser, and the like. The refrigerator may wiredly or wirelessly communicate with the external component through the communication unit 13. The current embodiment is not limited in communication method, and thus well-known communication technologies may be used.

Also, the refrigerator may further include a voice recognition unit 14 for recognizing an external voice, a voice analysis unit 15 for analyzing the voice inputted through the voice recognition unit 14, a speaker 16 for outputting the voice to the outside, and a memory 17 for storing information.

For example, the display unit 21 may include a touch screen on which information is inputted or selected in a touch manner. For another example, the display unit 21 may display simple information and input information through a separate input unit. Alternatively, a portion of the information may be inputted into the display unit 21, and another portion of the information may be inputted through the separate input unit.

The display unit 21 may be disposed on at least one of the refrigerating compartment door 20 and the freezing compartment door 30. Alternatively, the display unit 21 may be provided on a main body 10.

For example, the voice recognition unit 14 may be a microphone and may be provided in plurality. The voice analysis unit 15 may compare and analyze voices inputted through the plurality of voice recognition units 14 to reduce an analysis error due to noise. The voice analysis unit 15 may analyze the inputted voices to extract information required for an operation (for example, a cooling function, a food management function, a memo function, and the like) of the refrigerator. Then, the extracted information may be transmitted to the control unit 12.

The control unit 12 may recognize at least food information and information required for the food management. The food information may include a food classification (for example, categories such as vegetables, meats, marine products, milk products, grains, and the like) or food names. The information required for the food management may include at least one of a storage starting date, a reference storage period, a position to be stored, a storage amount (number or weight), and a storage method. The food management object may include storage position management, storage period management, storage amount management, and storage method management.

Also, the storage period management object may include at least one of a storage elapsing period from the storage starting date to the present date, a storage remaining period from the present date to a storage ending date (expiration date), a storage ending date, and whether the storage period reaches the reference storage period. The control unit 12 may perform the food management on the basis of the recognized food information and the information required for the food management. Here, whether the storage period reaches the reference storage period may be whether the storage period is within the reference storage period or whether storage period exceeds the reference storage period from the reference date.

The food information and the information required for the food management may be selected or inputted through the display unit 21 or may be inputted by using text or voice through a separate input unit.

Also, the refrigerator may include a first detection unit 51 for detecting an opening/closing of the refrigerating compartment door 20, a second detection unit 52 for detecting an opening/closing of the main door 310 of the refrigerating compartment door 30, and a third detection unit 53 for detecting an opening/closing of the sub door 340 of the refrigerating compartment door 30.

The control unit 12 may be connected to each of the detection units 51 to 53 to control the display unit 21 on the basis of the information detected by the detection units 51 to 53.

For another example, the control unit 12 may be omitted, and thus, the main control unit 11 may control the display unit 21. In this case, the main control unit 11 may be connected to each of the detection units 51 to 53 to control the display unit 21 on the basis of the information detected by the detection units 51 to 53.

For another example, the main control unit 11 may be connected to each of the detection units 51 to 53 to transmit the information detected by the detection units 51 to 53, and thus the control unit 12 may control the display unit 21 on the basis of the received information.

Figure 3:
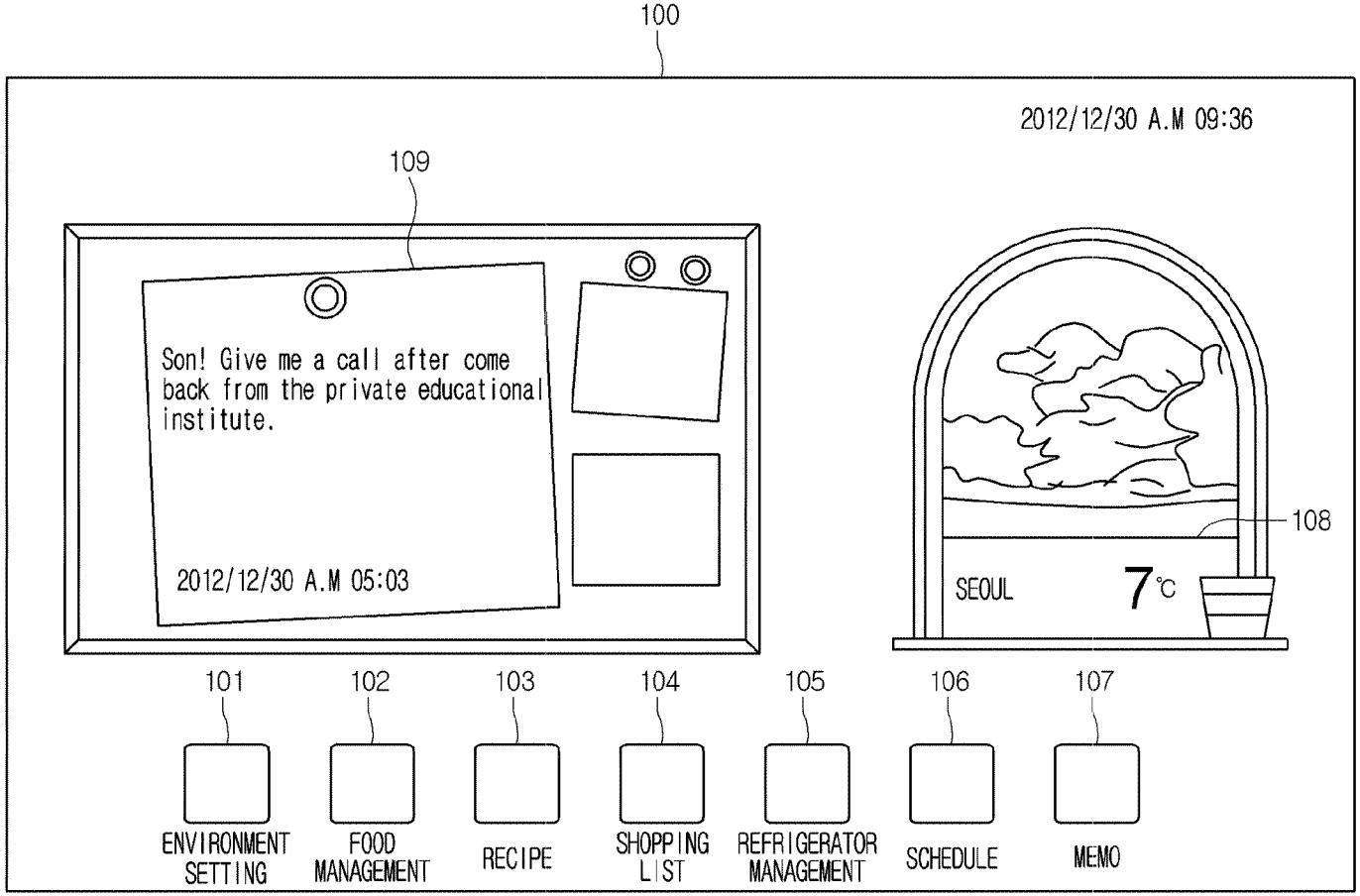
FIG. 3 is a view illustrating an example of a screen displayed on a display unit according to an embodiment.

FIG. 3 is a view illustrating an example of a screen displayed on a display unit according to an embodiment.

Referring to FIG. 3, when the refrigerator is turned on, a main screen 100 may be displayed on the display unit 21.

Alternatively, when the refrigerator is turned on, and the display unit 21 is touched in a state where the display unit 21 is in a power save mode, the main screen 100 may be displayed on the display unit 21.

Selection parts 101, 102, 103, 104, 105, 106, and 107 for selecting various functions of the refrigerator, weather information 108, memo information 109, or schedule information may be displayed on the main screen 100.

The selection part may include at least one of an environment setting selection part 101 for setting operation environment of the display unit 21, a food management selection part 102 to be selected for the food management stored in the refrigerator, a recipe selection part 103 to be selected for recipe generation or inquiry, a shopping list selection part 104 to be selected for foods required for shopping, a refrigerator management selection part 105 to be selected for a cooling function of the refrigerator, a schedule selection part 106 to be selected for schedule management, and a memo selection part 107 to be selected for writing a memo.

That is, the selection parts displayed on the main screen 100 may include a selection part related to the cooling function of the refrigerator and a selection part related to an additional function in addition to the cooling function. Hereinafter, a case in which the food management selection part 102 is selected on the main screen 100 will be described.

Also, when a specific selection part is selected on the main screen 100, the main screen may display a function management screen (or a detailed screen) corresponding to the selected selection part.

Figure 4:
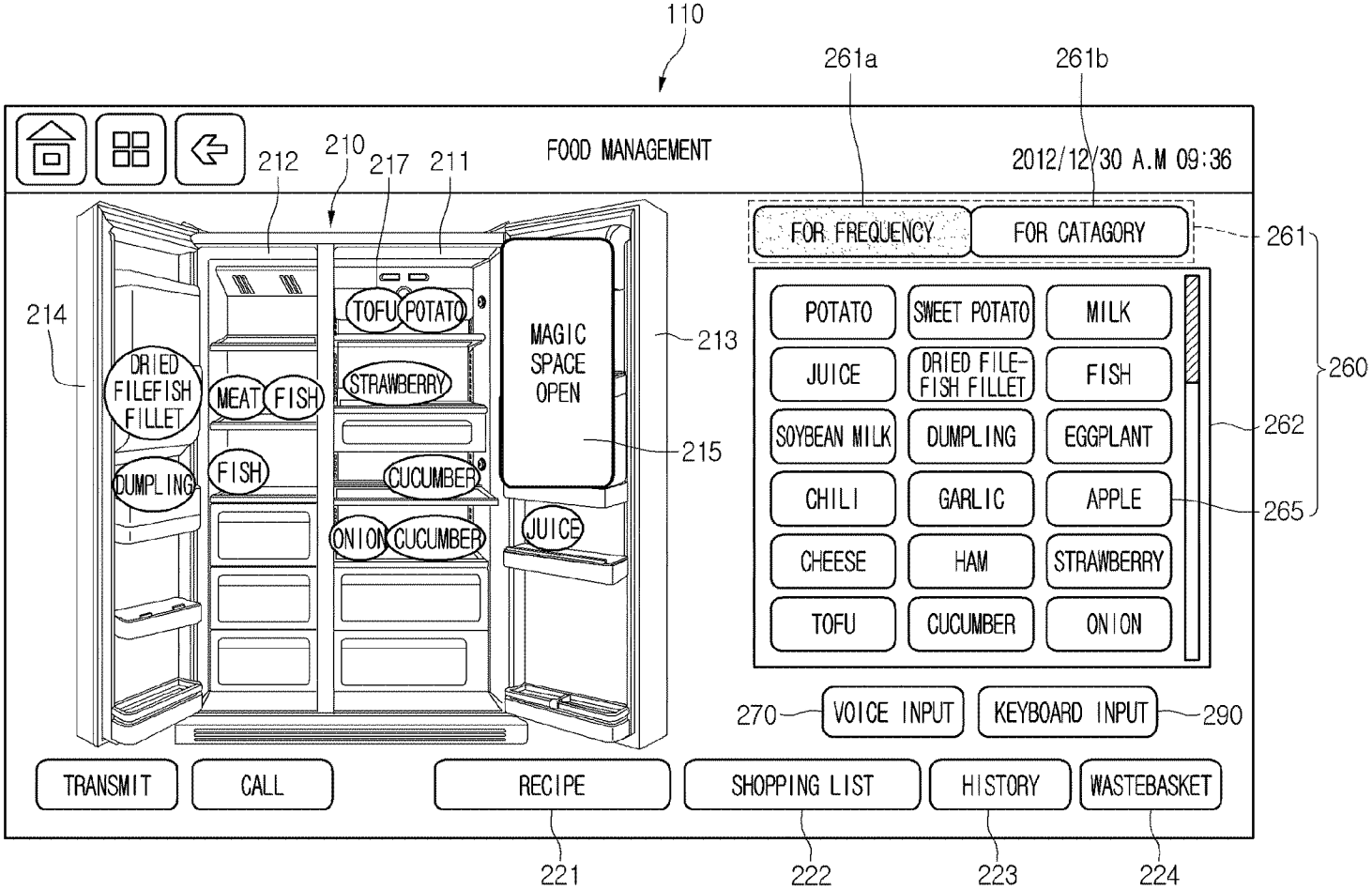
FIG. 4 is a view illustrating an example of a screen displayed when a food management selection part is selected on the screen of FIG. 3.

FIG. 4 is a view illustrating an example of a screen displayed when the food management selection part is selected on the screen of FIG. 3.

Referring to FIG. 4, when the food management selection part 102 is selected on the main screen of FIG. 3, a food management screen 110 that is an example of the function management screen is displayed on the display unit 21. Food position information 210 for displaying a position of a stored food and food list information 260 including display information of food to be added as the food management object may be displayed on the food management screen 110.

Also, a recipe selection part 221 to be selected for confirming recipe information, a shopping list selection part 222 to be selected for confirming shopping list information, a history selection part 223 to be selected for confirming past food consumption information, a voice input selection part 270 for adding foods to the food management object through a voice input, a keyboard input selection part 290 (text input selection part) for allowing a user to directly input text (characters, symbols, figures, and the like), thereby adding food to the food management object, and a wastebasket 224 to be selected to remove food from a storage management target foods may be further displayed on the food management screen 110.

The food position information 210 and the food list information 260 may be separately displayed on the food management screen 110, for example, may be displayed in a horizontal or vertical direction. The food position information 210 may be, for example, displayed in a refrigerator shape.

That is, refrigerating compartment information 211, refrigerating compartment door information 213, freezing compartment information 212, freezing compartment door information 214, and home bar information 215 may be separately displayed on the food position information 210. The refrigerating compartment information 211, the freezing compartment information 212, the refrigerating compartment door information 213, the freezing compartment door information 214, and the home bar information 215 may include at least one storage space information. The refrigerating compartment information 211, the freezing compartment information 212, the refrigerating compartment door information 213, and the freezing compartment door information 214 may include at least one storage food information 217 for displaying the stored foods. For example, the storage food information 217 may include food information or the food information and number.

Also, when the home bar information 215 is selected as shown in FIG. 4, a screen (that will be described later) of FIG. 5 may be displayed on the display unit 21.

The food list information 260 may include a category selection part 261 and a food information display part 262 on which information corresponding to the category selection part 261 is displayed. Food display information 265 or food classification may be displayed on the food information display part 262.

The information for displaying the stored food may be called the storage food information 217, and the information displayed on the food list information screen 260 may be called the food display information 265. Each of the storage food information 217 and the food display information 265 may be expressed as an icon having a food shape or food name, for example.

One of a category frequency 261*a* and a food classification category 261*b* may be selected by using the category selection part 261. FIG. 4 illustrates a food information display part 262 displayed when the category frequency 261*a* is selected. At least one food display information 265 may be aligned and displayed on the display information display part 262 in an order of foods having relatively high storage frequencies.

In the current embodiment, foods belonging to the food classification may be previously stored in the memory 17, and foods that are not stored in the memory 17 may be manually inputted and added.

In addition to the category frequency 261*a* and the food classification category 261*b*, the user may add a new category. For example, the user may add a preference category to select and confirm user's favorite foods through the preference category.

When the user selects specific food display information 265 on the food information display part 262 and then drags the selected food display information 265 to move the dragged food display information 265 into a specific storage space on a screen on which the food position information 210 is displayed, the specific storage food information 217 may be added to the specific storage space. Here, the food display information 265 selected on the food information display part 262 may not be deleted from the food list information 260, but be added to the food position information screen 210 as the storage food information 217.

Here, a color for expressing the storage food information 217 disposed on the food position information 210 may be different according to the storage period information. For example, the storage food information 217 that reaches the storage ending date may be expressed in a red color, the storage food information 217 in which the storage remaining date is left over 3 days or less may be expressed in an orange color, and the storage food information 217 in which the storage remaining date is left over 4 days or more may be expressed in a blue color.

When the specific storage food information 217 disposed on the food position information is selected and dragged to move the selected storage food information 217 to the wastebasket 224, the specific storage food information 217 may be removed from the food position information 210. That is, the storage food information 217 moved to the wastebasket 225 may be deleted from the food management object.

Figure 5:
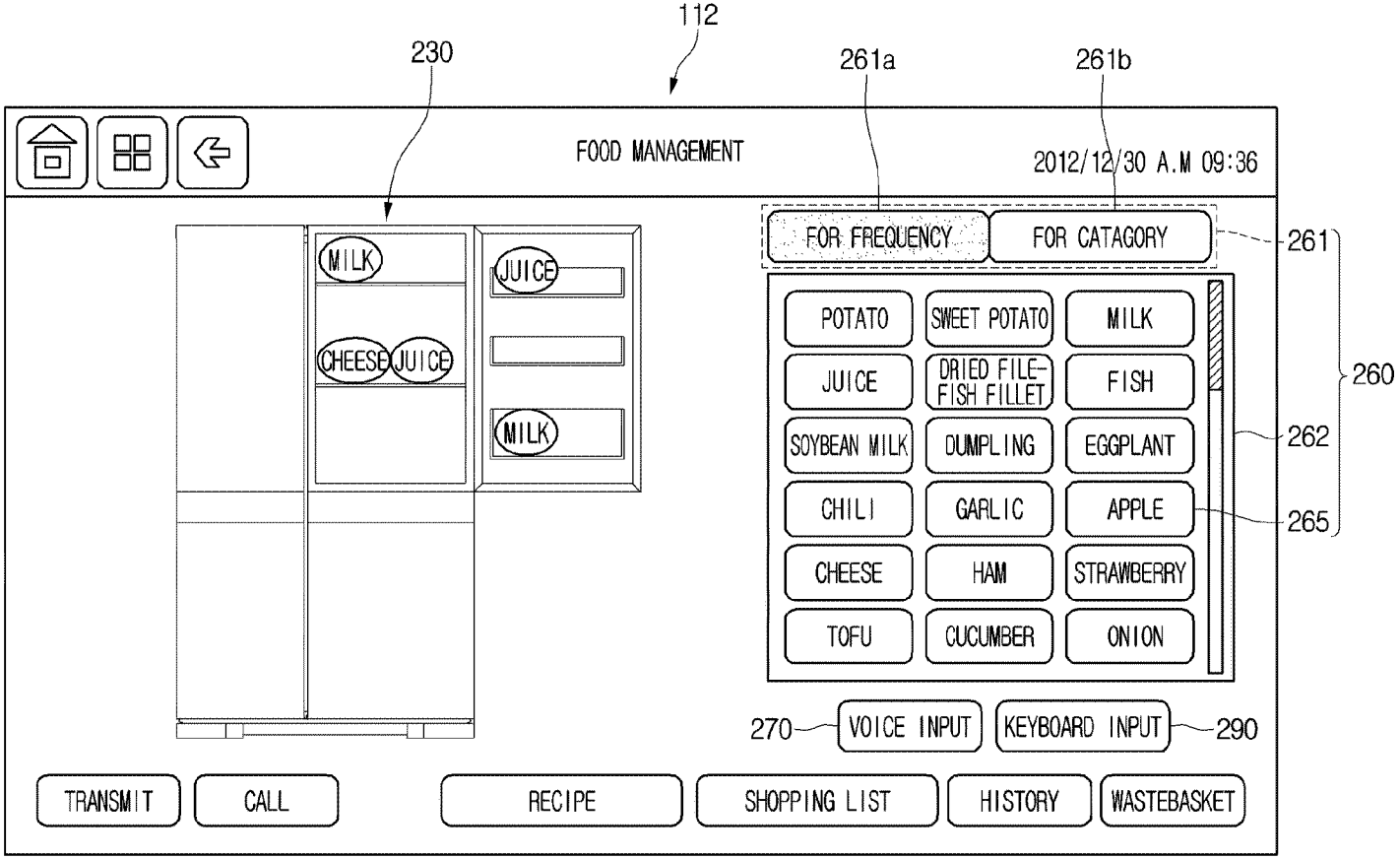
FIG. 5 is a view illustrating an example a screen displayed on the display unit when an opened or closed state of a sub door is detected according to an embodiment.

FIG. 5 is a view illustrating an example a screen displayed on the display unit when an opened state of a sub door is detected according to an embodiment.

In a state where the doors 20, 30, and 40 of the refrigerator are closed, when a predetermined time elapses, the display unit 21 may be changed into the power save mode. When the display unit 21 is in the power save mode, the display unit 21 may be turned off.

Also, a mode before the display unit 21 enters into the power saving mode after a command input is completed on the display unit 21 or the separate input unit may be called a standby mode. In the standby mode of the display unit 21, the presently displayed screen may be displayed for a predetermined time.

Referring to FIG. 5, when an opened state of the sub door 340 is detected by the third detection unit 53 in the power save mode of the display unit 21, the food management screen 112 for the food management in the home bar space 405 may be displayed on the display unit 21. That is, when the opened state of the sub door 340 is detected by the third detection unit 53, the display unit 21 may be turned on, and then, the main screen 100 may not be displayed on the display unit 21, but the food management screen 112 may be directly displayed on the display unit 21. For another example, after the main screen 100 is displayed on the display unit 21, the main screen 110 may be changed just into the food management screen 112.

The food position information 230 may be displayed on the food management screen 112. The food position information 230 may be displayed in the form of the refrigerator. Here, the form of the refrigerator displaying the food position information 230 may be expressed in a shape in which the sub door is opened in a state where the freezing compartment door is closed, and the main door of the refrigerator compartment is closed.

Also, the food list information 260 may be further displayed on the food management screen 112. Here, the food management screen 112 displayed on the screen of FIG. 5 may be equal to the food management screen 110 of FIG. 4 except for the food position information.

Thus, the user may input, delete, or modify the food information or the information required for the food management on the food management screen 112.

According to the embodiment, since the food management screen 112 is directly displayed on the display unit 21 in the state where the sub door 340 is opened, the user does not have to select the food management selection part 102 on the main screen and the home bar information 215 on the screen of FIG. 4. Thus, the user's convenience may be improved.

For another example, when the closed state of the sub door 340 after the sub door 340 is opened is detected by the third detection unit 53 in the power save mode of the display unit 21, the display unit 21 may be turned on, and then, the main screen 100 may not be displayed on the display unit 21, but the food management screen 112 may be directly displayed on the display unit 21. For another example, the main screen 100 may be changed into the food management screen 112 on the display unit 21 after the main screen 100 is displayed on the display unit 21.

When the opened state of the freezing compartment door 20 is detected, or the closed state of the freezing compartment door 20 after the freezing compartment door 20 is opened is detected in the power save mode of the display unit 21, the display unit 21 may be turned on, and the food management screen 110 of FIG. 4 may be displayed on the display unit 21.

Also, when the opened state of the main door 310 is detected, or the closed state of the main door 310 after the main door 310 is opened is detected in the power save mode of the display unit 21, the display unit 21 may be turned on, and the food management screen 110 of FIG. 4 may be displayed on the display unit 21.

For another example, in a state where an opened state of a specific door (e.g., the sub door) is detected to display a specific screen on the display unit 210, an opened state of the other door (e.g., the freezing compartment door or the main door except for the sub door) may be detected before the closed state of the specific door is detected. In this case, the specific screen presently displayed on the display unit 210 may be changed into a screen that has to be displayed when the opened state of the corresponding door is detected, or the specific screen presently displayed on the display unit 210 and the screen that has to be displayed when the opened state of the corresponding door is detected may be displayed at the same time.

Also, when one door is closed where the two screens are displayed on the display unit 21, the screen corresponding to the closed door may disappear.

While the specific screen (e.g., the food management screen 110 of FIG. 4) is displayed on the display unit 21 in the standby mode, when the closed state of the sub door 340 after the sub door 340 is opened or closed is detected, the specific screen may be changed into the food management screen 112.

Also, while the specific screen (e.g., the main screen or a food management screen 112 of FIG. 5) is displayed on the display unit 21 in the standby mode, when the closed state of the freezing compartment door 20 or the main door 310 after the freezing compartment door 20 or the main door 310 is opened or closed is detected, the specific screen may be changed into the food management screen 110.

Also, while the food management screen 110 of FIG. 4 is displayed on the display unit 21 in the standby mode, when the closed state of the freezing compartment door 20 or the main door 310 after the freezing compartment door 20 or the main door 310 is opened or closed is detected, the presently displayed specific screen may be continuously displayed.

Also, when a specific door is opened while the main screen 100 is displayed in the standby mode of the display unit 21, the main screen 100 may be changed into other screens.

When the opened state of the specific door is detected, or the closed state of the specific door after the specific door is opened is detected, the screen displayed on the display unit 21 may be changed by the user. Hereinafter, another example of a screen to be displayed when the opened/closed state of the freezing compartment door 20 is detected will be described.

Figure 6:
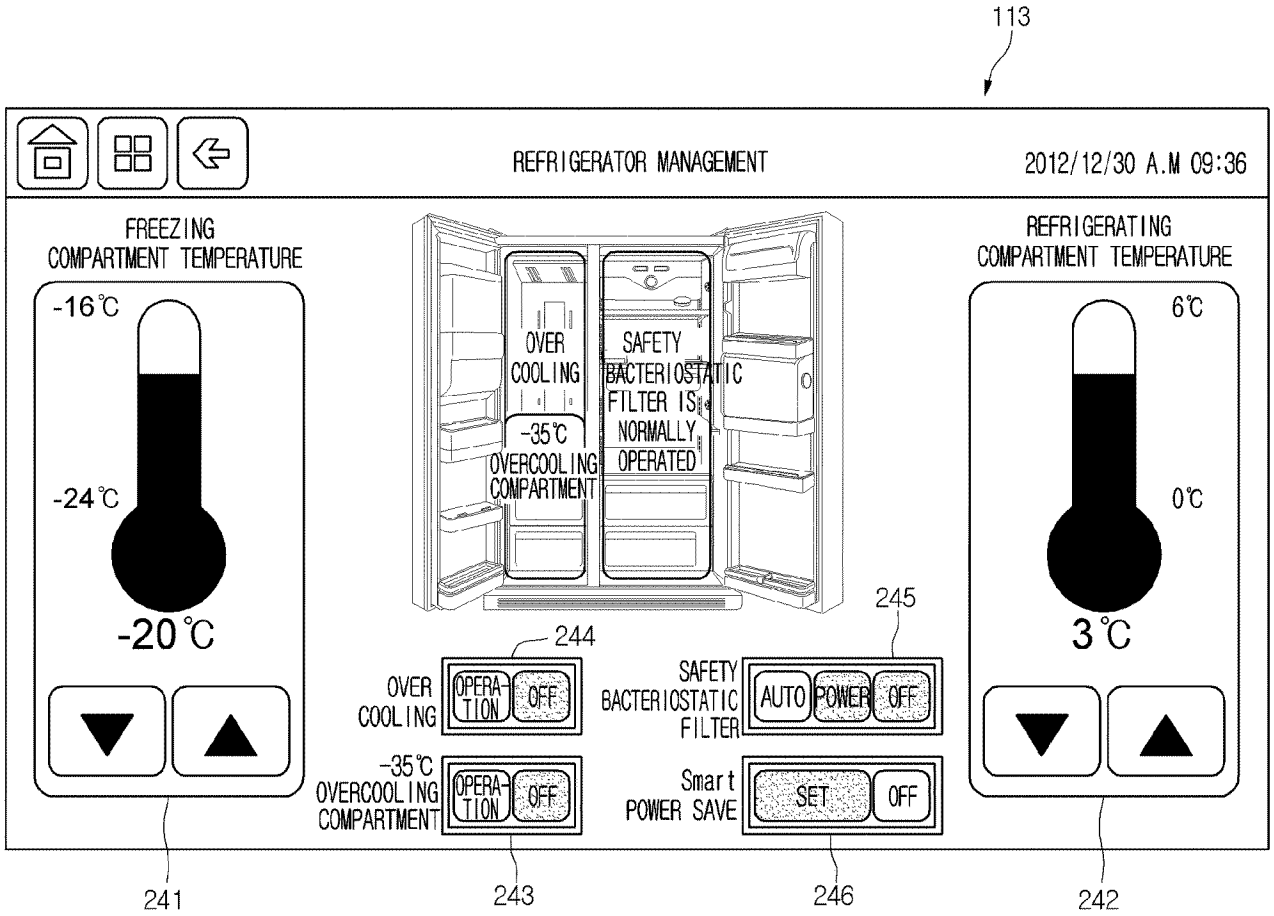
FIG. 6 is a view illustrating an example a screen displayed on the display unit when an opened or closed state of a refrigerator door is detected according to an embodiment.

FIG. 6 is a view illustrating an example of a screen displayed on the display unit when an opened or closed state of a refrigerator door is detected according to an embodiment.

Referring to FIG. 6, when the opened state of the freezing compartment door 20 is detected by the first detection unit 51, or the closed state of the freezing compartment door 20 after the freezing compartment door 20 is opened is detected by the first detection unit 51 in the power save mode of the display unit 21, a refrigerator management screen 113 that is an example of the function management screen may be displayed on the display unit 21.

At least freezing compartment temperature information and refrigerating compartment temperature information may be displayed on the refrigerator management screen 113.

Also, a freezing compartment temperature changing part 241 for changing a freezing compartment temperature, a refrigerating compartment temperature changing part 242 for changing a refrigerating compartment temperature, and a power save function selection part 246 for selecting one of the power save function and a generation function may be further displayed on the refrigerator management screen 113.

Also, at least one of a selection part 243 for selecting an operation of an overcooling compartment, a selection part 244 for selecting the overcooling function, and a selection part 245 for selecting an operation of a filter may be further displayed on the refrigerator management screen 113.

Although the refrigerator management screen of FIG. 6 is displayed when the opened/closed state of the freezing compartment door is detected in the foregoing embodiment, the current embodiment is not limited thereto. For example, when the opened/closed state of the main door or sub door of the refrigerating compartment door is detected, the refrigerator management screen of FIG. 6 may be displayed.

In summary, when the opened or closed state of the specific door is detected in the power save mode of the display unit 21, the display unit 21 may be turned on, and at least one of the function management screens except for the main screen 21 may be displayed on the display unit 21. For example, at least one of the function management screens such as an environment setting screen, a food management screen, a recipe management screen, a shopping list screen, a refrigerator management screen, a schedule management screen, and a memo management screen which are capable of being displayed on the display unit 21 may be displayed. Here, the foregoing embodiment is not limited to the function management screen displayed on the display unit 21.

Here, the function management screen according to the embodiment may include a screen that is displayed when the specific selection part is selected on the main screen 21 as well as a detailed function management screen displayed when the selection part is selected on the function management screen.

Also, although the function management screen is displayed on the display unit when the opened or closed state of the specific door is detected by the detection unit in the foregoing embodiment, the current embodiment is not limited thereto. For example, on the other hand, when the opened state of the specific door is detected, the function management screen may be displayed, and when the closed state of the specific door is detected, the presently displayed function management screen may be changed into the other function management screen. For example, when the opened state of the freezing compartment door is detected, the food management screen may be displayed on the display unit. Also, when the closed state of the freezing compartment door is detected, the refrigerator management screen may be displayed on the display unit.

Also, although the refrigerator is described as an example of the home appliance, the current embodiment is not limited thereto. For example, the ideas of the present disclosure may be applicable to a home appliance including a storage compartment in which a consumable is accommodated and a door for opening/closing the storage compartment, such as washing machines, dryers, cookers, and the like.

Here, the consumables may be, for example, a product or material that is used or treated when the home appliance is operated. For example, the consumable may include a fabric to be washed in the washing machine, food to be cooked in the cooker, a detergent or fabric softener used for washing the fabric to be washed in the washing machine, seasoning used for cooking the food to be cooked, and foods within the refrigerator.

As described above, the screen displayed on the display unit of the home appliance may include the main screen and the function management screen. Here, when the opened or closed state of the door is detected, the function management screen may be directly displayed on the display unit.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A home appliance comprising:

a main body having a storage compartment;

a door that opens or closes the storage compartment;

a detection unit to detect an opening or closing of the door;

a display unit disposed on the main body or the door to display information; and a control unit configured to control the display unit on the basis of the detection by the detection unit, wherein the control unit is configured to change a display on the display unit from a main screen to a function management screen in response to a command inputted on the main screen when the main screen is displayed on the display unit, and the control unit is configured to change the display on the display unit from the main screen to the function management screen in response to the opening or closing of the door detected by the detection unit when the main screen is displayed on the display unit, the home appliance further comprising an additional door;

another detection unit to detect an opening or closing of the additional door;

wherein the control unit is configured to control the display unit on the basis of the detection by the another detection unit, the control unit configured to display on the display unit another function management screen in response to the opening or closing of the additional door detected by the another detection unit, and the control unit is configured to display the function management screen and the another function management screen at the same time on the display when the opening of the additional door is detected by the another detection unit while the opening of the door is detected by the detection unit.

2. The home appliance according to claim 1, wherein the display unit includes a power saving mode in which the display unit is turned off, and while the display unit is in the power saving mode before the opening or closing of the door is detected by the detection unit, the control unit is configured to turn on the display unit to display the function management screen on the display unit in response to the opening or closing of the door detected by the detection unit.

3. The home appliance according to claim 1, wherein when the opening or closing of the door is detected while the function management screen is displayed on the display unit, the control unit is configured to continuously display the presently displayed function management screen on the display unit when the function management screen to be displayed when the door is opened or closed is the same as the function management screen presently displayed on the display unit.

4. The home appliance according to claim 1, wherein the function management screen displayed on the display unit when the opening of the door is detected is different from the function management screen displayed on the display unit when the closed state of the door is detected, the control unit is configured to display the different function management screen on the display unit.

5. The home appliance according to claim 1, wherein the home appliance comprises a refrigerator, and the function management screen comprises a food management screen to manage foods stored in the refrigerator.

6. The home appliance according to claim 5, wherein the food management screen comprises food position information.

7. The home appliance according to claim 6, wherein the control unit is configured to display the food position information on the display unit as a refrigerator shape displaying a state of a door corresponding to an opened or closed door.

8. The home appliance according to claim 7, wherein the food position information comprises information about storage food that reaches the storage ending date expressed in one color, storage food in which the storage remaining date is left over 3 days or less expressed in another color, and storage food in which the storage remaining date is left over 4 days or more expressed in yet another color.

9. The home appliance according to claim 7, wherein the food management screen comprises food list information that comprises storage food information expressed as an icon and the icon can be dragged to a storage space in the refrigerator shape of the food position information.

10. The home appliance according to claim 1, wherein the home appliance comprises one of a refrigerator, a washing machine, a cleaner, and a cooker.

* * * * *